United States Patent [19]

Sielaff

[11] Patent Number: 4,498,800

[45] Date of Patent: Feb. 12, 1985

[54] JUNCTION PLATE

[75] Inventor: Ulrich Sielaff, Madison, Wis.

[73] Assignee: United Steel Products Company, Montgomery, Minn.

[21] Appl. No.: 449,173

[22] Filed: Dec. 13, 1982

[51] Int. Cl.[3] ..... F16D 1/00

[52] U.S. Cl. ..... 403/172; 403/217; 52/81

[58] Field of Search ..... 403/171, 172, 176, 170, 403/217, 218, 219; 52/81, 82

[56] References Cited

U.S. PATENT DOCUMENTS

| | | | |
|---|---|---|---|
| 2,803,317 | 8/1957 | Henderson | 52/650 |
| 3,270,478 | 9/1966 | Attwood | 403/218 X |
| 3,486,278 | 12/1969 | Woods | 52/81 |
| 3,844,664 | 10/1974 | Hogan | 52/81 X |
| 3,857,212 | 12/1974 | Barnett | 52/81 |
| 3,861,107 | 1/1975 | Papayoti | 403/171 X |
| 3,990,195 | 11/1976 | Gunther | 403/175 X |
| 4,203,265 | 5/1980 | Ivers et al. | 52/81 |
| 4,384,801 | 5/1983 | Hamel | 403/172 |

FOREIGN PATENT DOCUMENTS 2421920 11/1975 Fed. Rep. of Germany ..... 52/81

*Primary Examiner*—Andrew V. Kundrat

*Attorney, Agent, or Firm*—Dorsey & Whitney

[57] ABSTRACT

A junction plate is disclosed which is formed by stamping from a metal disk and which is adapted to secure together a plurality of main struts to form a polygonal geodesic structure, such as an icosahedron. The junction plate includes a series of main strut channels which are bent relative to a flat central portion of the plate so that they are parallel to the main struts of the structure to receive and hold the main struts in the main strut channels. There are also formed in the plate a series of auxiliary strut channels intended to receive ends of auxiliary struts which may be inserted into the structure to support the surface faces of the structure to allow easier covering of the structure using conventional building materials. The auxiliary strut channels are particularly shaped and adapted to allow easy and quick installation of auxiliary struts into the structure with a minimum of shaping necessary to the auxiliary strut.

7 Claims, 7 Drawing Figures

JUNCTION PLATE

FIELD OF THE INVENTION

The present invention relates to metal junction plates for building structures in general, and, in particular, to junction plates intended to form connectors for polygonal geodesic building structures.

DESCRIPTION OF THE PRIOR ART

The prior art is generally cognizant of the concept of building geodesic building structures which are generally complex polygonal geometric structures constructed from a plurality of triangular planar face surfaces joined together at junction points. One typical method used for the construction of such geodesic type building structures is to utilize uniform sized struts which are joined together by connector plates at each junction point to fix the relationship between struts emanating in all directions from that junction plate. In the construction of geodesic type structures utilizing wooden struts, one convenient technique is to use stamped metal junction plates to facilitate the construction of the geodesic structures and to rigidify the orientation between the struts of a partial structure during the construction of the complete geometric structure. Examples of prior art junction plates utilized for the construction of such geodesic structures include U.S. Pat. No. 3,844,664, to Hogan, U.S. Pat. No. 3,857,212, to Barnett, U.S. Pat. No. 3,270,478, to Attwood, U.S. Pat. No. 4,203,265, to Ivers, U.S. Pat. No. 3,486,278, to Woods, U.S. Pat. No. 2,803,317, to Henderson, and U.S. Pat. No. 3,990,195, to Gunther. These prior art junction plates used to facilitate the construction of geodesic structures are often very complex to use, requiring trained or skilled personnel, and making the construction of such structures impractical for inexperienced builders or homeowners who desire to construct such a structure for themselves.

At least one example has been demonstrated in the prior art, that in pending U.S. patent application Ser. No. 340,008, to Hamel of a stamped metal plate which may be utilized as the junction plate for the construction of a geodesic type building structure. The plate as described by Hamel is intended to facilitate the construction of a geodesic structure by an unskilled or unsophisticated user as easily as possible by providing a sculptured channel in the plate to receive one end of each of the struts of the geometric structure. With that plate, each of the struts is secured in the respective channel by a single bolt with the sculptured shape of the channel fixing the orientation between the individual strut and the junction plate. The sculptured channels of the plate described in that patent application facilitate the quick and rapid construction of the frame work of such a geodesic structure in a minimum amount of time by an unskilled user. This junction plate structure is completely satisfactory for the erection of a geodesic type structure up to a given practical limit in size. This practical limit in size occurs because of the necessity for utilizing standard construction materials as the surface coverings to cover the triangular faces of the geodesic structure. Such standard building materials, such as plywood, generally come in four foot sheets and thus are often not wide enough to bridge across a triangular face of a polygonal structure if the strut length on any of the faces of the triangle exceeds four feet. To compensate for this factor, it is often the practice to insert ancillary or auxiliary struts in each of the triangular faces of a polygonal structure to shorten the distance across which such plywood facing material must typically extend. Such auxiliary struts may also be necessary to support the faces of the structures so proper loadings can be achieved. It is often difficult to firmly, accurately and quickly install such auxiliary struts into such a structure however and to securely fix them in place. Such installation also may require relatively sophisticated shaping of the ends of the auxiliary struts.

SUMMARY OF THE INVENTION

The present invention is summarized in that in a junction plate formed by stamping from a metal disk and used to shape a polygonal geodesic structure by joining a plurality of main struts, the junction plate includes a flat central portion; a skirt portion of the plate formed into a generally frusto-conical shape extending from the periphery of the plate to the central portion; a plurality of main strut channels formed intended into the skirt portion of the plate extending radially outward from the central portion, each of the main strut channels bent relative to the central portion by an angle selected so that the channels are generally parallel to the main struts; an auxiliary strut channel formed intended into the skirt portion between each of the main strut channels, the auxiliary strut channels being bent at an angle relative to the central portion so as to be generally parallel to the adjacent face of the polygonal geodesic structure adapted so that an auxiliary strut inserted to support that face can be easily secured in the auxiliary strut channel of the plate with a minimum of shaping to the auxiliary strut.

It is an object of the present invention to provide a junction plate which facilitates the rapid and easy construction of a polygonal geodesic structure which facilitates the heretofore difficult problem of inserting auxiliary struts into the structure to support the surface facings of the structure at points intermediate the main struts in each of the triangular faces of the structure.

It is another object of the present invention to provide such a junction plate in which the shaping of the ends of the auxiliary struts which are to be inserted into the structure is kept to an absolute minimum.

It is yet another object of the present invention to provide such a junction plate which may be simply stamped in a single step from a sheet of metallic material and which has minimal deformation to it during the stamping process so as to not weaken the junction plate and its subsequent structural installation.

Other objects, advantages, and features of the present invention will become apparent from the following specification when taken in conjunction with the accompanying drawings.

DESCRIPTION OF THE PREFERRED EMBODIMENT

Figure 1:
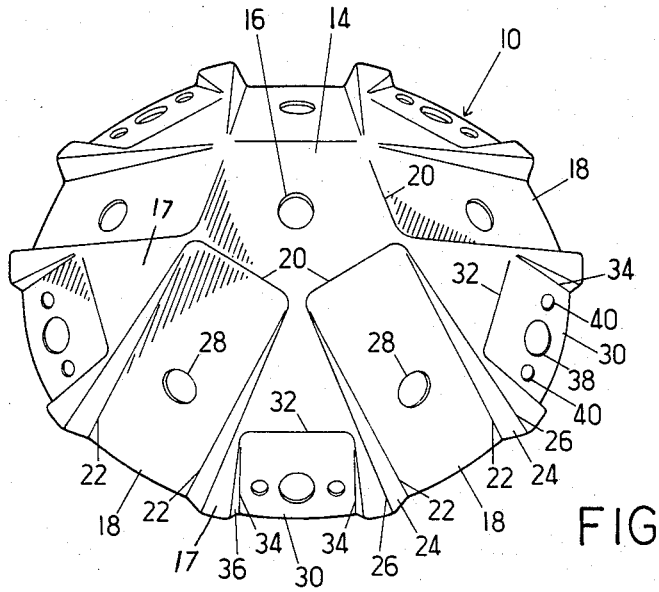
FIG. 1 is a perspective inverted view of an improved junction plate constructed in accordance with the present invention.

Shown in FIG. 1 and generally illustrated at 10, is a junction plate constructed in accordance with the present invention. The junction plate 10 of FIG. 1 is a metallic plate for joining structural frame members to form a polygonal geodesic building structure, such as the icosahedron illustrated in FIG. 2, and generally designated at 12. The junction plate 10 of FIG. 1 is particularly adapted and constructed so that it may be easily used to construct the geodesic structure 12 in a rapid and efficient manner by an unskilled user, and is particularly adapted for use in constructing larger structures in which auxiliary struts may be needed for structural support of surface faces the completed structure.

Referring in particular to FIG. 1, the junction plate 10 is a generally frusto-conically shaped stamped metal plate formed from stamped sheet steel or other metallic material. The central portion of the junction plate 10 is a pentagonal central portion 14 which is a flat planar portion of the sheet metal material. A registration hole 16 is formed in the center of the base portion 16 to facilitate stamping of the plate 10. From the central portion 14 the remaining portion of the frusto-conical shape of the junction plate 10 turns outwardly and downwardly in a smooth conical fashion to form a skirt portion 17. A series of five identical main strut channels 18 are indented into the skirt portion 17 of the junction plate 10 and extend radially outward from the central portion 14. Each of the main strut channels 18 is defined by a respective bend line 20 joining the channel 18 to the central portion 14 at its inward end and by a pair of side bend lines 22 defining the sides of each of the channels 18. The bend at the bend line 20 is defined so that the channel 18 is oriented to be parallel to the main strut to which it fastens, as will be further discussed below. Each of the side bend lines 22 defines one side of one of generally upstanding vertical side walls 24 defining the sides of each of the main strut channels 18. The details of these components may also be viewed in FIGS. 3 and 4. The height of each of the side walls 24 increases in dimension from zero at the inside bend line 20 to a dimension at the periphery of the junction plate 10 being of sufficient size so as to be capable of retaining a main strut in place inside of the channel 18 as will be described below in further detail. A centrally located fastening hole 26 is formed in each of the main strut channels 18.

Located in between each of the main strut channels 18 in an intervening section of the skirt portion 17 is an auxiliary strut channel 30. The five auxiliary strut channels 30 are also formed as inwardly indented portions of the cylindrical surface of the skirt portion 17 of the junction plate 10. Each of the auxiliary strut channels 30 is defined by an inward bend line 32 and by a pair of side bend lines 34. Sidewalls 36 form the sides of each of the auxiliary strut channels 30 and increase in dimension from zero at the inward bend line 30 to a dimension at the periphery of the junction plate 10 sufficient to restrain an auxiliary strut as will be described below in more detail. The auxiliary strut channels 30 are bent relative to the central portion 14 along the inward bend line 32 at an angle such that the auxiliary strut channel 30 is parallel to the adjacent surface face of the geodesic structure. Centrally formed in each of the auxiliary strut channels 30 is both a large bolt fastening hole 38 and two smaller nail fastening holes 40.

Figure 2:
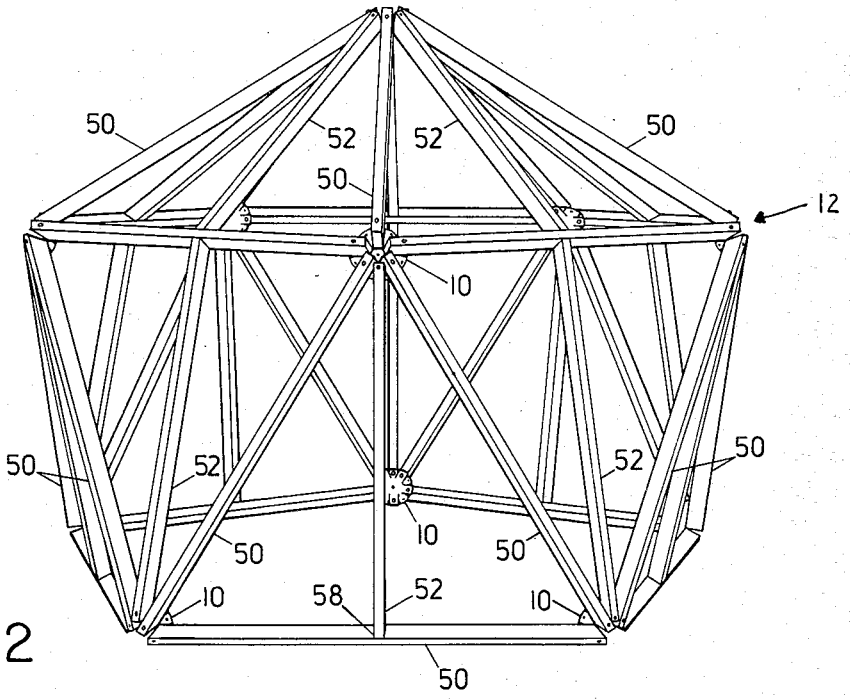
FIG. 2 is a side elevational view of a geodesic structure constructed with the junction plate of FIG. 1.

The junction plate 10 of FIG. 1 is intended to be utilized in the construction of a polygonal geodesic building structure 12 as illustrated in FIG. 2. In constructing a geodesic building using the junction plates 10, it is necessary to utilize eleven of the junction plates 10 and twenty-five main struts 50. Each of the main struts 50 are preferably formed by pieces of conventional framing lumber, such as 2×4s, of equal length. Each of the main struts 50 has a single hole bored through it along its longer lateral axis adjacent to its ends so that it may be attached to the adjacent junction plate 10. Each end of each of the main struts 50 is then attached by a single bolt 60 to the adjacent junction plate 10. As the bolt 60 is tightened, the end of the main strut 50 is drawn into the appropriate channel 18 with the side walls 24 of the channel 18 acting against the sides of the main strut 50 to firmly, quickly and fixedly fix the angular orientation between the main strut 50 and the junction plate 10. This can be best seen with reference to FIG. 5 which is an underside view showing the attachment of the main struts 50 to the junction plate 10. The main struts 50 require no alteration, shaping, or adaption to them prior to installation to the junction plate 10 other than the drilling of the single hole to receive the bolt 60. The assembly of the twenty-five main struts 50 together with the eleven junction plates 10 forms a structure as illustrated in FIG. 2 without the addition of the auxiliary struts 52 thereto. This structure thus formed is a polygonal geodesic structure which is composed of a plurality of triangular surface faces, one of which is illustrated in an enlarged view in FIG. 6.

Figure 6:
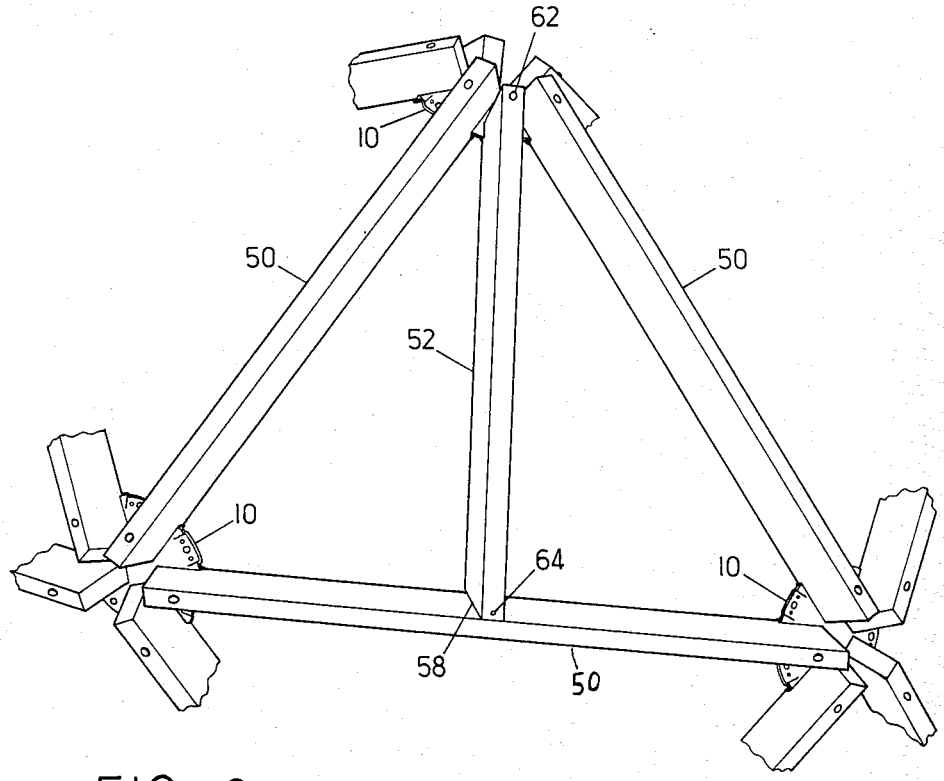
FIG. 6 is an enlarged perspective view of one triangular section of a geodesic structure such as that illustrated in FIG. 2.

As can be illustrated in FIG. 6, each of the surface faces of the polygonal structure 12 of FIG. 2 is defined by a triangle formed by three of the main struts 50. At each apex of the triangle formed by the three main struts 50 is one of the junction plates 10. Each of the channels 18 in each of the junction plates 10 is oriented so that the ends of the main struts 50 may be joined securely thereto, and it is for this reason that the angle of the channels 18 is selected to be parallel to the direction in which the adjacent main strut 50 extends. If the length of the main struts 50 exceeds four feet, which is often desirable, it can readily be seen by referring to FIG. 4 that a common sheet of structural surface covering material, such as plywood, could not extend in an unbroken fashion to completely cover the triangular face surface illustrated in FIG. 6. It is for this reason that an auxiliary strut, such as that illustrated at 52 in FIG. 6, is necessary. Through the use of such an auxiliary strut 52 the distance which the surface facing material must span can be reduced by one half. The auxiliary strut 52, as illustrated in FIG. 6, is attached at one end to a junction plate 10 and at its other end to a midpoint of a one of the main struts 50. The junction plate 10 of the present invention is particularly adapted to facilitate the installation of such auxiliary struts 52 into the surface faces of the polygonal geodesic structure, as illustrated in FIG. 2 so that larger structures can be easily and quickly constructed utilizing the junction plate 10.

Figure 7:
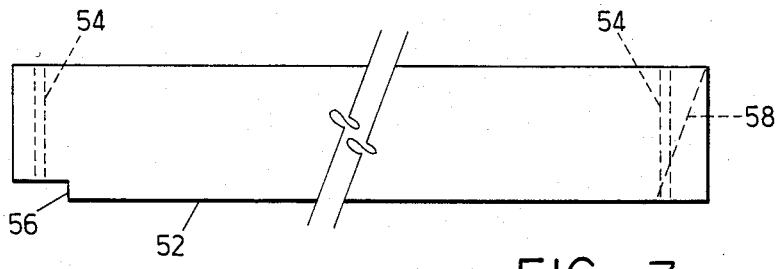
FIG. 7 is a side plan view schematically illustrating the modifications which need to be made to an auxiliary strut to be installed in the geodesic structure of FIG. 2.

To install the auxiliary strut 52 into the geodesic structure 12, some minimal shaping is required to the auxiliary strut 52. This shaping is illustrated in FIG. 7. The primary required shaping consists of the cutting of a rabbet 56 to the one end of the auxiliary strut 52. This rabbet must be sufficiently long in length, measured along the longitudinal axis of the auxiliary strut 52, to accommodate the auxiliary strut channel 30 of the junction plate 10 to which it is attached. Depending on the manner in which the auxiliary strut 52 is to be attached to the junction plate 10, a bolt hole 54 may be necessary adjacent to the rabbet 56 drilled through the longer lateral axis of the auxiliary strut 52 adjacent to the end thereof. At the opposite end of the auxiliary strut 52, a miter cut 58 is made so that the opposite end of the auxiliary strut 52 abuts directly against the main strut 50 to facilitate nailing of the auxiliary strut 52 to the main strut 50. If an alternative method of attaching the auxiliary strut 52 to the main strut 50 is to be used, another connecting bore hole 54 may be drilled through the longer lateral axis of the auxiliary strut 52 to facilitate attachment of the auxiliary strut 52 to a metal connecting plate.

Figure 4:
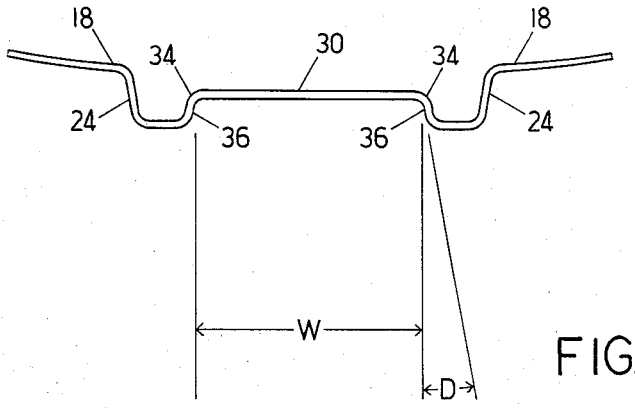
FIG. 4 is an edge-on enlarged view of a one of the auxiliary channels of the improved junction plate of FIGS. 1 and 3.
Figure 5:
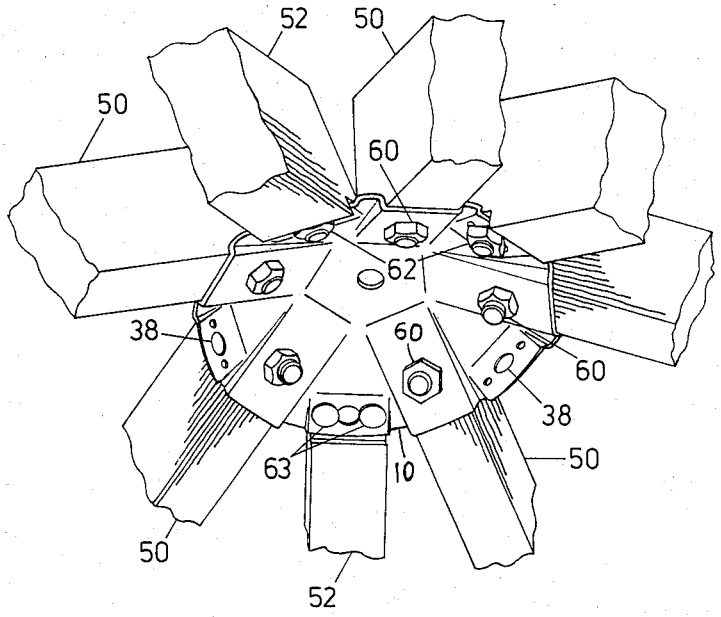
FIG. 5 is an enlarged underside view of one of the junction plates of FIGS. 1 and 3 as installed in a geodesic structure such as that illustrated in FIG. 2.

In installing the auxiliary strut 52 into a triangular face of the geodesic structure, as illustrated in FIG. 6, the auxiliary strut 52 is placed in position and a bolt 62 is inserted through the hole 54 drilled through the end of the auxiliary strut 52 having the rabbet 56. The rabbeted end of the auxiliary strut 52 is placed into the appropriate auxiliary strut channel 30 in the junction plate 10 to which the auxiliary strut 52 is to be attached. This is illustrated at the top apex of the triangular face of the geodesic structure as illustrated in FIG. 6. The tightening of this bolt 62 will draw the rabbeted end of the auxiliary strut 52 into the auxiliary strut channel 30 formed in the junction plate 10. As illustrated in FIG. 4, the auxiliary strut channel 30, which is defined on its lateral edges by the bend lines 34 which form one side of the side walls 36, has a width W. That width W is selected so as to correspond generally to the width of the auxiliary strut 52 along its shorter lateral axis. For conventional construction lumber this will be approximately $1\frac{1}{2}$ inches. The side walls 36 of the auxiliary strut channel 30 will be selected so as to extend slightly outwardly from normal to the bottom of the auxiliary strut channel 30 by an angle D. That angle will be selected to be approximately 10°. Therefore, as the bolt 62, which extends through the bolt hole 54 in the auxiliary strut 52 and the bolt hole 38 in the auxiliary strut channel 30, is tightened, the auxiliary strut is pulled into the auxiliary strut channel 30 and the side walls 36 of the auxiliary strut channel 30 cam the auxiliary strut 52 into a fixed angular relationship relative to the junction plate 10. Thus only one fastening unit is required to attach the end of the auxiliary strut 52 to the junction plate 10. The other end of the auxiliary strut 52 can be attached to the oppositely oriented main strut 50 by a single nail 64 if the miter cut 58 has been made to the opposite end of the auxiliary strut 52, as is illustrated in the auxiliary strut 52 of FIG. 6. Although the nail 64 illustrated in FIG. 6 is driven through the auxiliary strut 52 and into the main strut 50, it is preferred that the nail be driven through the main strut 50 into the end of the auxiliary strut 52. As an alternative method for attaching the auxiliary strut 52 to the junction plate 10, the auxiliary strut 52 may be clamped firmly in the channel 30 so that the side walls 36 can act on the auxiliary strut 52, and a pair of nails 63 may be driven through the nail holes 40 in the auxiliary strut channel 30, as illustrated at the bottom of FIG. 5.

Figure 3:
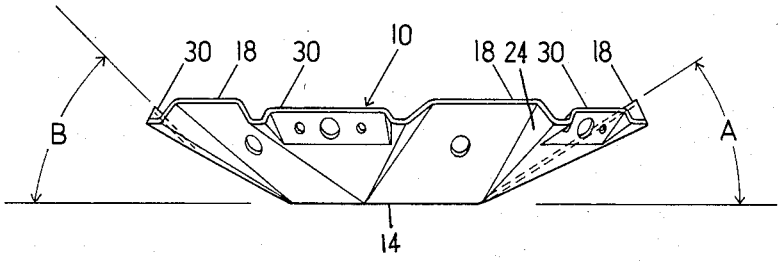
FIG. 3 is a side elevational view of the junction plate of FIG. 1 illustrating the angles of the channels thereof.

The angles of the main strut channels 18 and the auxiliary strut channels 30 are particularly selected to facilitate the easy and rapid construction of the geodesic structure 12 of FIG. 2. As illustrated in FIG. 3, the main strut channels 18 form an angle A relative to the central portion 14. That angle is selected so that the main strut channels 18 are oriented parallel to the angle at which the main struts 50 extend away from the junction plate 10. For an icosahedron, such as that illustrated at 12 in FIG. 2, angle A should be selected to be approximately 31.7°. Similarly, the auxiliary strut channels 30 are constructed to be of a selected angle B which is selected so that the auxiliary strut channels 30 are oriented at an angle parallel to the direction at which the auxiliary struts 52 will extend away from the junction plate 10. This angle is also parallel to the plane formed by the triangular surface face of the geodesic structure formed by the three main struts 50 illustrated in FIG. 6. For icosahedron, the angle B is preferably approximately 37.4°. While the junction plate 10 is particularly appropriate and efficiently used in the construction of an icosahedron, it should be appreciated that other geometric shapes may be erected utilizing a junction plate similar to that described and illustrated at 10 herein, and that other appropriate angles for angles A and B would be necessary for geometric shape having a greater or smaller number of faces.

Thus through the use of the junction plate 10 constructed in accordance with the present invention it is possible to rapidly and quickly construct a polygonal geodesic structure including both main struts 50 and auxiliary struts 52. Through the use of such auxiliary struts 52 it is possible to more easily and quickly construct larger geodesic type structures using commonly available building materials than might have heretofore been practical. Because of the appropriate shaping, sizing, and angling of the auxiliary strut channels 30, a minimum of shaping is required to appropriately and quickly install the auxiliary struts 52. This shaping consists solely of a single rabbet 56 to the end of the auxiliary strut 52 which is to be attached to the junction plate 10. Once this simple shaping is done, the auxiliary strut may easily and quickly be inserted into the geodesic structure.

It is to be understood that the present invention is not limited to the particular arrangement and construction of parts illustrated herein, but embraces all such modified forms thereof as come within the scope of the following claims.

I claim:

1. A junction plate (10) formed by stamping from a metal disk and for securing a plurality of main struts (50) together to form a polygonal geodesic structure, the junction plate (10) comprising:

a flat central portion (14);

a skirt portion (17) of the plate (10) formed into a generally frusto-conical shape extending from the periphery of the plate to the central portion (14);

a plurality of main strut channels (18) formed into the skirt portion (17) of the plate extending radially outward from the central portion (14), each of the main strut channels (18) bent relative to the central portion (14) by a first angle relative to said central portion, said first angle selected so that said main strut channels (18) are generally parallel to the main struts (50), an auxiliary strut channel (30) formed into the skirt portion (17) between each of the main strut channels (18), the auxiliary strut channels (30) being bent at a second angle relative to said central portion (14), said second angle selected so as to be generally parallel to the adjacent face of the polygonal geodesic structure defined by the corresponding main struts so that an auxiliary strut (52) inserted to support that face can be easily secured in the auxiliary strut channel (30) of the plate with a minimum of shaping to the auxiliary strut (52).

2. A junction plate as claimed in claim 1 wherein each of the auxiliary strut channels (30) includes formed therein a bolt fastening hole (38) adapted to receive a bolt (62) extending through the auxiliary strut (52).

3. A junction plate as claimed in claim 1 wherein each of the auxiliary strut channels (30) includes formed therein a pair of nail fastening holes (40) adapted to receive nails (63) fastening the auxiliary strut (52) to the plate (10).

4. A junction plate as claimed in claim 1 wherein the shaping necessary to the auxiliary strut (52) includes cutting a rabbet (56) in the end of the auxiliary strut (52).

5. A junction plate as claimed in claim 1 wherein each auxiliary strut channel (30) is bent relative to the skirt portion (17) by a single linear bend line (32) and has its sides defined by linear side bend lines (34).

6. A junction plate as claimed in claim 1 wherein the polygonal structure is an icosahedron and wherein there are five of each of the main strut channels (18) and the auxiliary strut channels (30) in each plate (10).

7. A junction plate (10) formed by stamping from a metal disk and for securing a plurality of main struts (50) together to form a polygonal icosahedron geodesic structure, the junction plate (10) comprising:

a flat central portion (14);

a skirt portion (17) of the plate (10) formed into a generally frusto-conical shape extending from the periphery of the plate to the central portion (14);

five main strut channels (18) formed into the skirt portion (17) of the plate extending radially outward from the central portion (14), each of the main strut channels (18) bent relative to the central portion (14) at an angle of approximately 31.4° so that the channels (18) are generally parallel to the main struts (50);

an auxiliary strut channel (30) formed into the skirt portion (17) between each of the main strut channels (18), the auxiliary strut channels (30) being bent at an angle of approximately 37.4° relative to the central portion (14) so as to be generally parallel to the adjacent face of the polygonal geodesic structure so that an auxiliary strut (52) inserted to support that face can be easily secured in the auxiliary strut channel (30) of the plate with a minimum of shaping to the auxiliary strut (52).

* * * * *